US008036570B2

(12) United States Patent
Itabashi

(10) Patent No.: US 8,036,570 B2
(45) Date of Patent: Oct. 11, 2011

(54) PROCESS CARTRIDGE

(75) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 449 days.

(21) Appl. No.: 12/341,133

(22) Filed: Dec. 22, 2008

(65) Prior Publication Data

US 2009/0169251 A1 Jul. 2, 2009

(30) Foreign Application Priority Data

Dec. 28, 2007 (JP) ..... 2007-338737

(51) Int. Cl.
*G03G 21/16* (2006.01)

(52) U.S. Cl. ..... 399/111; 399/89; 399/171

(58) Field of Classification Search ..... 399/89, 399/90, 111, 170–173
See application file for complete search history.

(56) References Cited

U.S. PATENT DOCUMENTS

| | | | | |
|---|---|---|---|---|
| 6,385,414 | B1 * | 5/2002 | Sato et al. | 399/98 |
| 7,085,516 | B2 | 8/2006 | Kawai et al. | |
| 7,356,286 | B2 * | 4/2008 | Itabashi et al. | 399/170 |
| 2006/0018683 | A1 | 1/2006 | Itabashi | |

FOREIGN PATENT DOCUMENTS

| | | |
|---|---|---|
| JP | 08-305102 | 11/1996 |
| JP | 2003-223091 | 8/2003 |
| JP | 2006-039139 | 2/2006 |

* cited by examiner

*Primary Examiner* — Hoang Ngo
(74) *Attorney, Agent, or Firm* — Banner & Witcoff, Ltd

(57) ABSTRACT

A process cartridge includes a photosensitive member, a charger, which charges the photo sensitive member, and a process frame, which supports the photo sensitive member and the charger. The charger includes a charged wire, a grid that is interposed between the charged wire and the photosensitive member, a wire-side connecting portion that applies a voltage to the charged wire, and a grid-side connecting portion that applies a voltage to the charged wire. The process frame comprises an exposure opening that faces the photosensitive member, the exposure opening being provided between the wire-side connecting portion and the grid-side connecting portion when viewed from a first direction in which the charged wire is stretched.

11 Claims, 8 Drawing Sheets

PROCESS CARTRIDGE

CROSS-REFERENCE TO RELATED APPLICATIONS

This application claims priority from Japanese Patent Application No. 2007-338737 filed on Dec. 28, 2007, the entire subject matter of which is incorporated herein by reference.

TECHNICAL FIELD

Aspects of the invention relate to a process cartridge having a charger that generates a corona discharge.

BACKGROUND

There has been proposed an image forming apparatus, such as a laser printer, in which a surface of a photosensitive drum charged by a charger is exposed to a laser beam, or the like, so as to form an electrostatic latent image on the surface of the photosensitive drum. Toner is supplied to the electrostatic latent image, and a toner image is formed on the surface of the photosensitive drum. The toner image is attracted by a transfer roller that nips a sheet along with the photosensitive drum, so that the toner image is transferred to the sheet to form an image.

JP-A-2006-39139 discloses a related image forming apparatus, in which a process cartridge having the photosensitive drum and a charger is removably mounted to an apparatus main unit. Specifically, the charger provided in the process cartridge of JP-A-2006-39139 is constructed by including a stretched charged wire, a grid having a plurality of pores for generating a corona discharge between the grid and the charged wire, a wire electrode for applying a voltage to the charged wire, and a grid electrode for applying a voltage to the grid.

The wire electrode and the grid electrode are exposed outside from a side surface of the process cartridge. Accordingly, when the process cartridge is mounted to the apparatus main body, the electrodes are connected to electrodes belong to the apparatus main body.

SUMMARY

Illustrative aspects of the invention provide a process cartridge that can prevent leakage of electricity from a wire electrode to a grid electrode.

DETAILED DESCRIPTION

General Overview

In the related process cartridge, if a size of the process cartridge is reduced, an area of the side surface through which the wire electrode and the grid electrode are exposed becomes smaller. However, when the wire electrode and the grid electrode are arranged closely to each other, electricity may be leaked from the wire electrode to the grid electrode.

Illustrative aspects of the invention provide a process cartridge that can prevent leakage of electricity from a wire electrode to a grid electrode.

According to a first illustrative aspect of the invention, there is provided a process cartridge comprising: a photosensitive member; a charger, which charges the photosensitive member, the charger comprising: a charged wire; a grid that is interposed between the charged wire and the photosensitive member; a wire-side connecting portion that applies a voltage to the charged wire; and a grid-side connecting portion that applies a voltage to the charged wire; and a process frame, which supports the photosensitive member and the charger, and which comprises an exposure opening that faces the photosensitive member, the exposure opening being provided between the wire-side connecting portion and the grid-side connecting portion when viewed from a first direction in which the charged wire is stretched.

According to a second illustrative aspect of the invention, there is provided an image forming apparatus comprising: the process cartridge according to the first aspect that is removably mounted to the image forming apparatus in a second direction which is perpendicular to the first direction; and a main body casing comprising: a first main body electrode that is connectable with the wire-side connecting portion; and a second main body electrode that is connectable with the grid-side connecting portion, wherein the wire-side connecting portion is elongated in the second direction.

EXEMPLARY EMBODIMENTS

Exemplary embodiments of the invention will now be described with reference to the drawings.

In the descriptions that follow, directions as used herein refer to directions indicated by the arrows as indicated in each figure. Incidentally, in FIG. 1, a right-left direction and a width direction of a sheet Pare equivalent. The directions are described with reference to directions of the user who uses an image forming apparatus.

Figure 1:
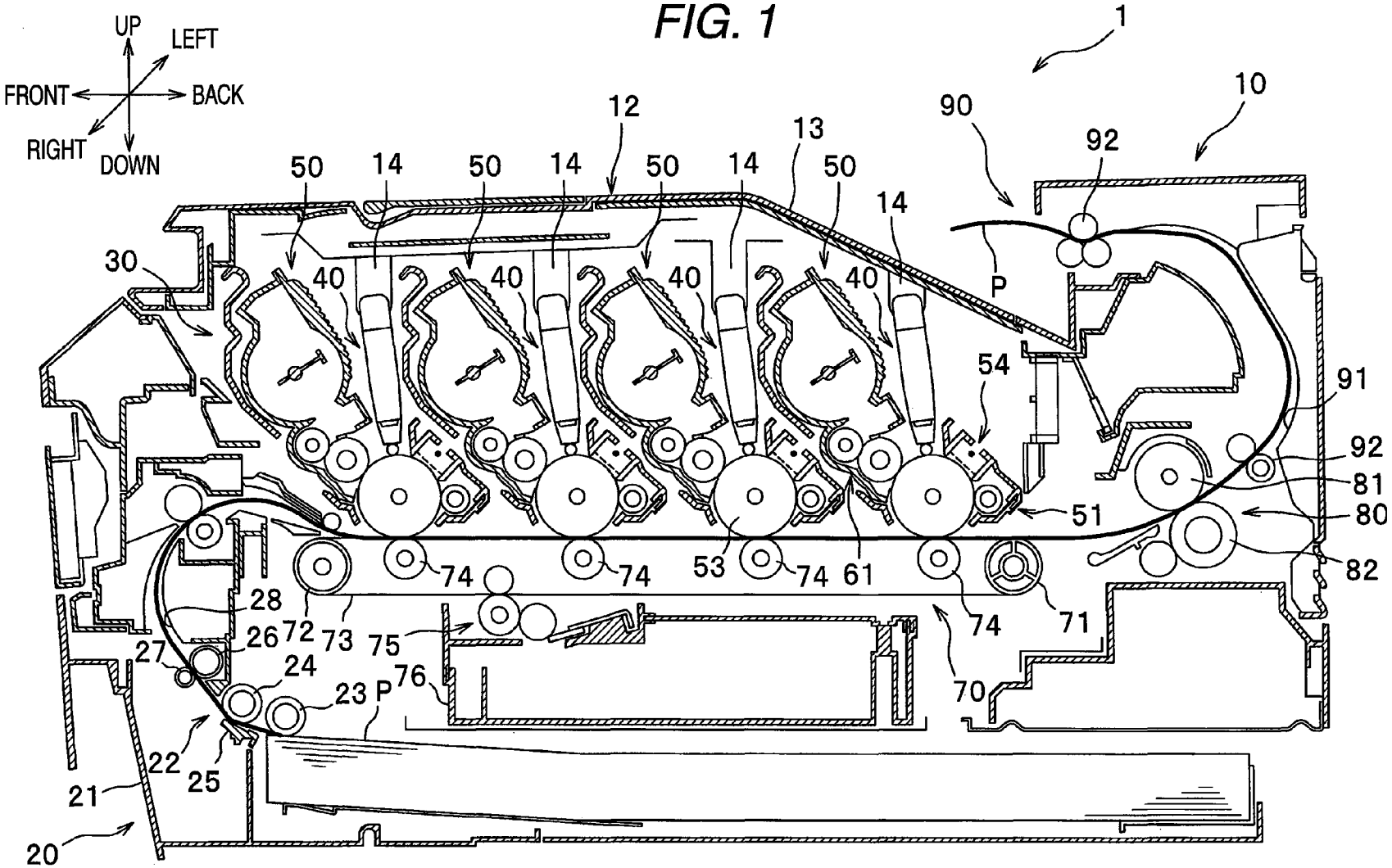
FIG. 1 is a cross-sectional view showing an image forming apparatus according to an exemplary embodiment of the invention.

As shown in FIG. 1, an image forming apparatus 1 includes, within a main body casing 10, a sheet feeding section 20 for feeding the sheet P, an image forming section 30 for forming an image on the fed sheet P, and a sheet discharging section 90 for ejecting the sheet P with the image formed thereon. A color printer is one example of the image forming apparatus 1.

An upper cover 12 is provided in an upper portion of the main body casing 10 so as to be able to vertically pivot around a hinge (not shown) provided in a back side of the cover. An upper surface of the upper cover 12 acts as a sheet discharging tray 13 for accumulating the sheets P ejected from the main body casing 10. A plurality of hold members 14 for holding LED units 40 (which will be described later) functioning as an example of an exposure unit are provided on a lower surface of the upper cover 12. A first main body electrode 101 and a second main body electrode 102 are provided in the main body casing 10.

The sheet feeding section 20 includes a sheet feeding tray 21 and a sheet feed mechanism 22. The sheet feeding tray 21 is disposed at a lower part in the main body casing 10 and is removably attached to the main body casing 10. The sheet feed mechanism 22 conveys the sheet P fed from the sheet feeding tray 21 to an image forming section 30. The sheet feed mechanism 22 includes a sheet feed roller 23, a separation roller 24, and a separation pad 25 which are disposed ahead of the sheet feeding tray 21.

In the sheet feeding section 20, the sheets P loaded in the sheet feeding tray 21 are separated one at a time, and the separated sheet is fed upwardly. During the course of the sheet passing between a paper dust removal roller 26 and a pinch roller 27, paper dust is removed from the sheet, and the direction of the sheet is turned backward by passing through a conveyance path 28. The turned sheet is fed to the image forming section 30.

The image forming section 30 includes four LED units 40, four process cartridges 50, a transfer unit 70 and a fixing unit 80.

Figure 2:
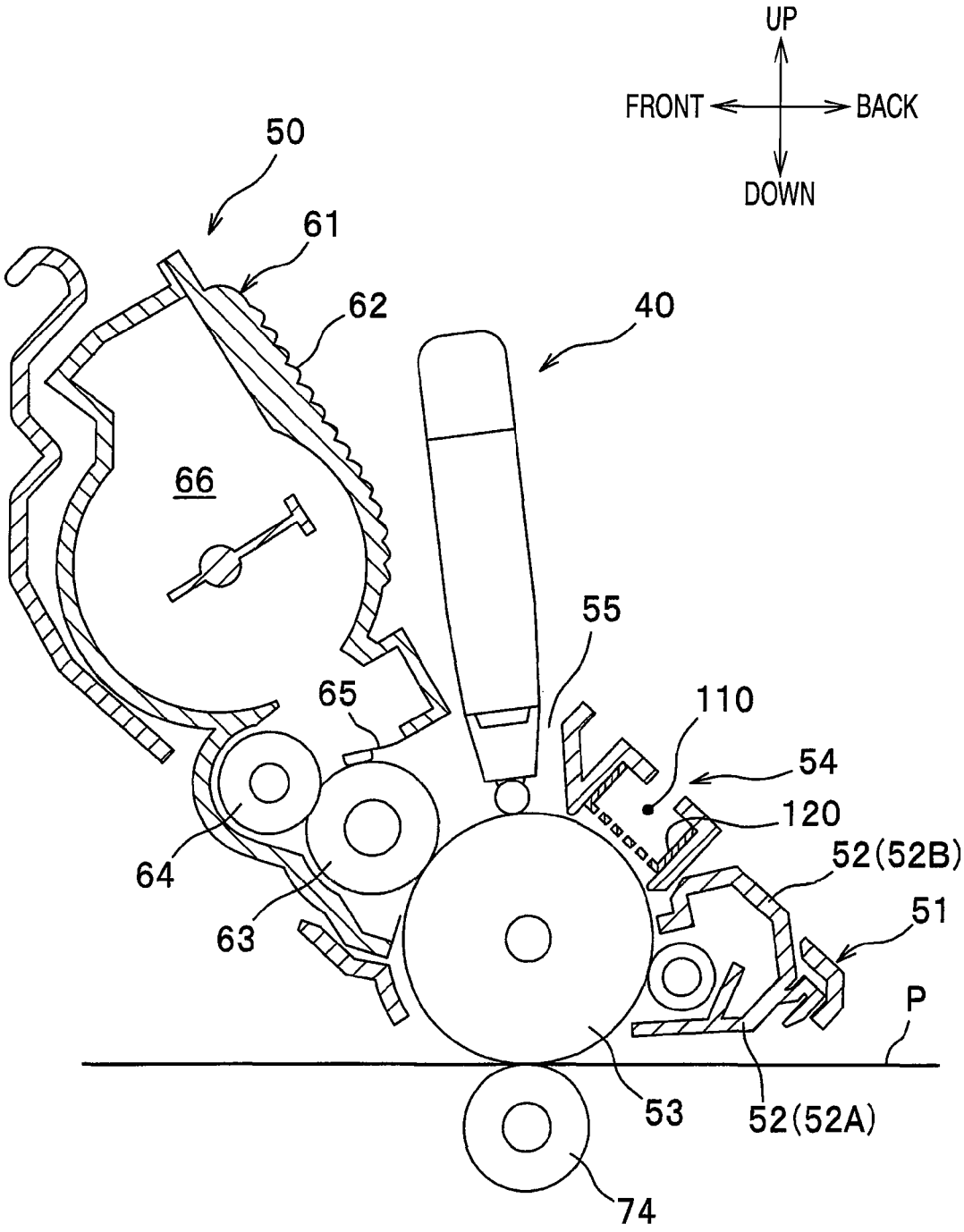
FIG. 2 is an enlarged cross-sectional view showing a process cartridge of the image forming apparatus.

The process cartridges 50 are arranged in a longitudinal line between the upper cover 12 and the sheet feeding section 20. As shown in FIG. 2, each of the process cartridges 50 has a drum unit 51 and a developing unit 61 that is removably attached to the drum unit 51. The process cartridges 50 differ from each other in terms of the color of developer accommodated in a developer storage chamber 66 of the developing unit 61, whereas the structures of the process cartridges 50 are identical with each other.

The drum unit 51 includes a drum frame 52, a photosensitive drum 53 rotatably supported by the drum frame 52, and a charger 54. The drum frame 52 functions as an example of a process frame. The photosensitive drum 53 functions as an example of a photosensitive member.

The drum frame 52 is configured such that, when the developing unit 61 is attached to the frame, an exposure hole 55 as an example of an exposure opening, through which the photosensitive drum 53 is viewed from an outside thereof, is formed in the drum frame 52. The LED unit 40 is inserted into the exposure hole 55 so as to oppose an upper surface of the photosensitive drum 53.

Each developing unit 61 includes a developing frame 62 as an example of a process frame, a developing roller 63 and a supply roller 64 which are rotatably supported by the developing frame 62, a blade component 65, and the developer storage chamber 66 that accommodates developer.

As shown in FIG. 1, a transfer unit 70 is provided between the sheet feeding section 20 and the respective process cartridges 50. The transfer unit 70 includes a drive roller 71, a driven roller 72, a conveyance belt 73, a transfer roller 74, and a cleaning section 75.

The drive roller 71 and the driven roller 72 are spaced away and in parallel with each other in the longitudinal direction. The conveyance belt 73 formed from an endless belt is stretched between the drive roller 71 and the driven roller 72. An exterior surface of the conveyance belt 73 is in contact with the respective photosensitive drums 53. Four transfer rollers 74 are provided inside of the conveyance belt 73 so as to oppose the respective photosensitive drums 53 while the conveyance belt 73 is sandwiched between the respective photosensitive drums 53 and the transfer rollers 74. At the time of transfer operation, a transfer bias is applied to the transfer roller 74 by means of constant current control.

The cleaning section 75 is disposed below the conveyance belt 73. The cleaning section 75 is configured so as to remove the developer adhering to the conveyance belt 73 and drop the removed developer into a developer accumulation section 76 disposed below the cleaning section.

The fixing unit 80 is provided in a back side of the respective process cartridges 50 and the transfer unit 70. The fixing unit 80 includes a heating roller 81 and a pressing roller 82 disposed opposite the heating roller 81 so as to press the heating roller 81.

In the image forming section 30, surfaces of the respective photosensitive drums 53 are uniformly charged by the charger 54 and exposed to light emitted from the respective LED units 40. Accordingly thereto, electric potentials of the exposed portions are reduced, and an electrostatic latent image based on image data is formed on each of the photosensitive drums 53.

The developer is supplied from the developer storage chambers 66 to the developing rollers 63 by rotation of the supply rollers 64. The developer is then supplied between the respective developing rollers 63 and the respective blade components 65 by means of rotation of the respective developing rollers 62. Thereafter, the developer is carried on the respective developing rollers 62 as a thin layer having a thickness.

When the developing rollers 63 face and contact the photosensitive drums 53, the developer carried on the respective developing rollers 63 are supplied to the electrostatic latent images formed on the respective photosensitive drums 53. The developer is selectively carried on the respective photosensitive drums 53, to visualize the electrostatic latent images. The developer image is formed by means of a reversal developing.

The sheet P fed onto the conveyance belt 73 passes between the respective photosensitive drums 53 and the respective transfer rollers 74 disposed in side of the conveyance belt 73, and the developer images formed on the respective photosensitive drums 53 are transferred onto the sheet P. When the sheet P passes between the heating roller 81 and the pressing roller 82, the developer images transferred on the sheet P are thermally fixed.

The sheet discharging section 90 includes a sheet-discharging-side conveyance path 91 and a plurality of conveyor roller pairs 92 for conveying the sheet P. The sheet-discharging-side conveyance path 91 extends upwardly from an exit of the fixing unit 80 and inverted to the front. The sheet P on which the developer images are transferred and thermally fixed is conveyed along the sheet-discharging-side conveyance path 91 by means of the conveyor rollers 92, ejected outside of the main body casing 10, and accumulated in the sheet discharging tray 13.

(Drum Frame and Charger)

Referring to FIGS. 3 to 7B, a structure of the drum frame 52 and a structure of the charger 54 will now be described.

1. Drum Frame

Figure 3:
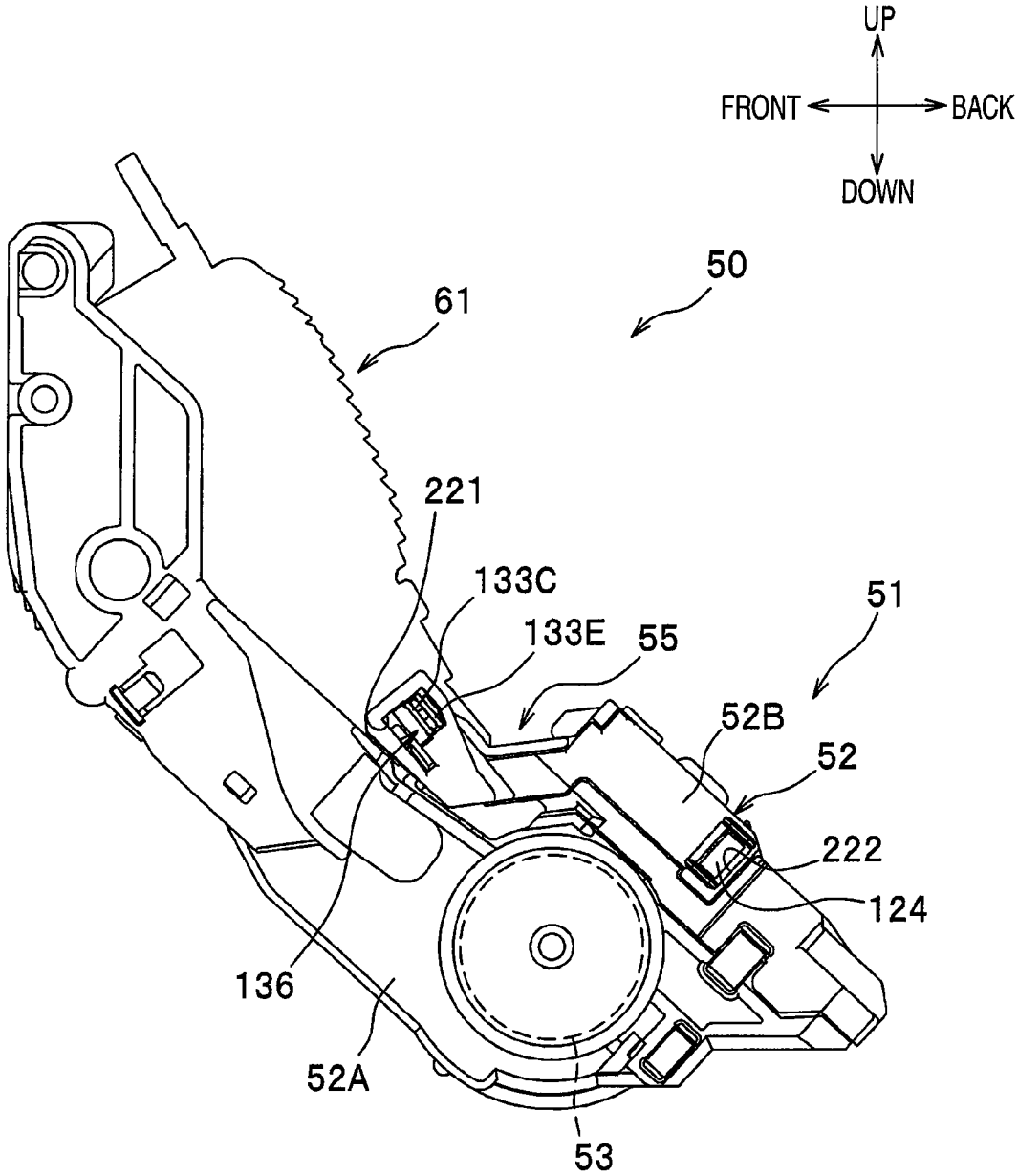
FIG. 3 is a side view of a drum frame and a developing unit of the process cartridge.

As shown in FIG. 3, the drum frame 52 includes a drum lower frame 52A and a drum upper frame 52B. The drum lower frame 52A supports the photosensitive drum 53, and the developing unit 61 is removably mounted to the drum lower frame 52A. The drum upper frame 52B supports the charger 54 (see FIG. 2) and is built into the drum lower frame 52A.

Figure 4:
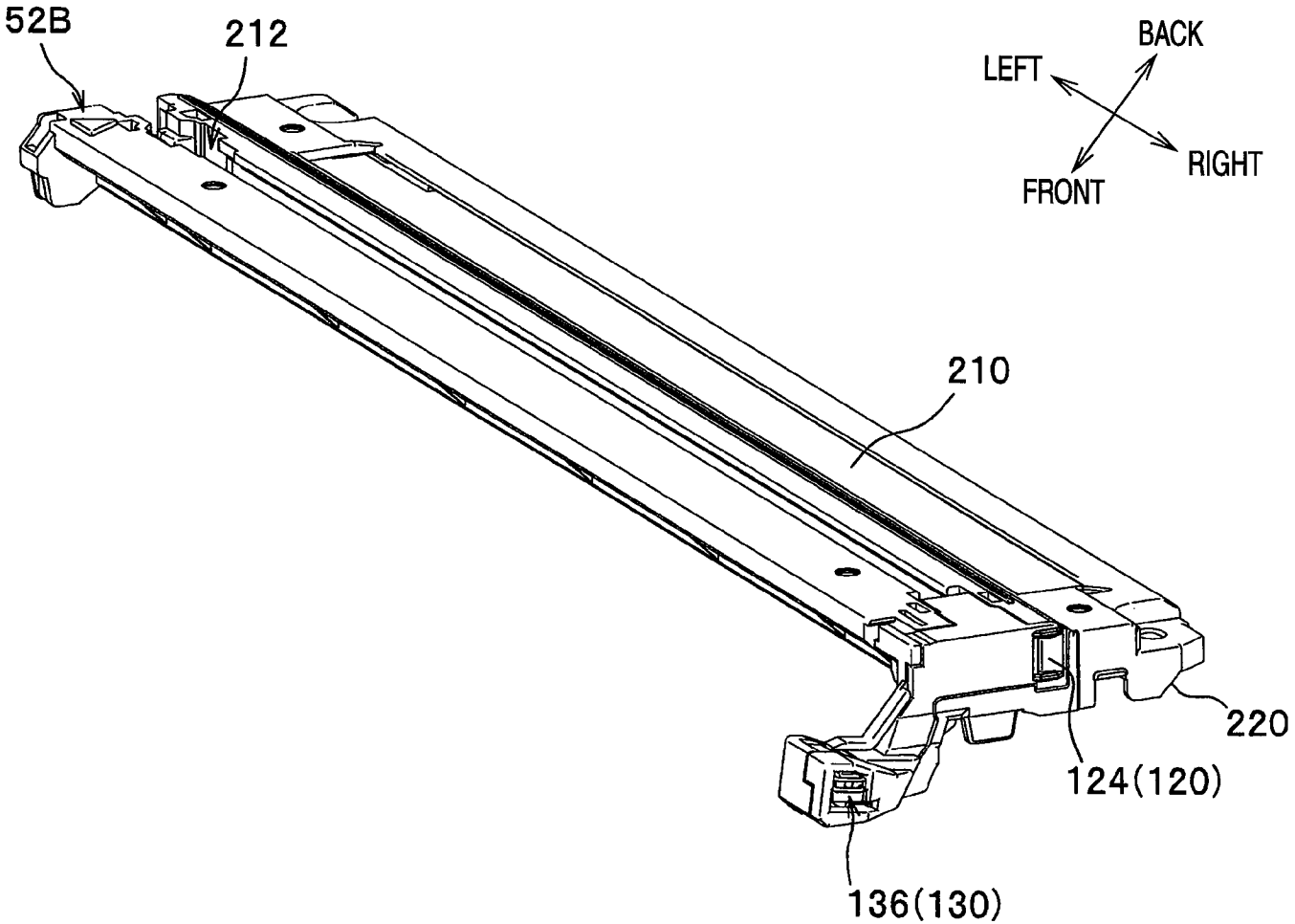
FIG. 4 is a perspective view of a drum upper frame of the process cartridge.
Figure 5:
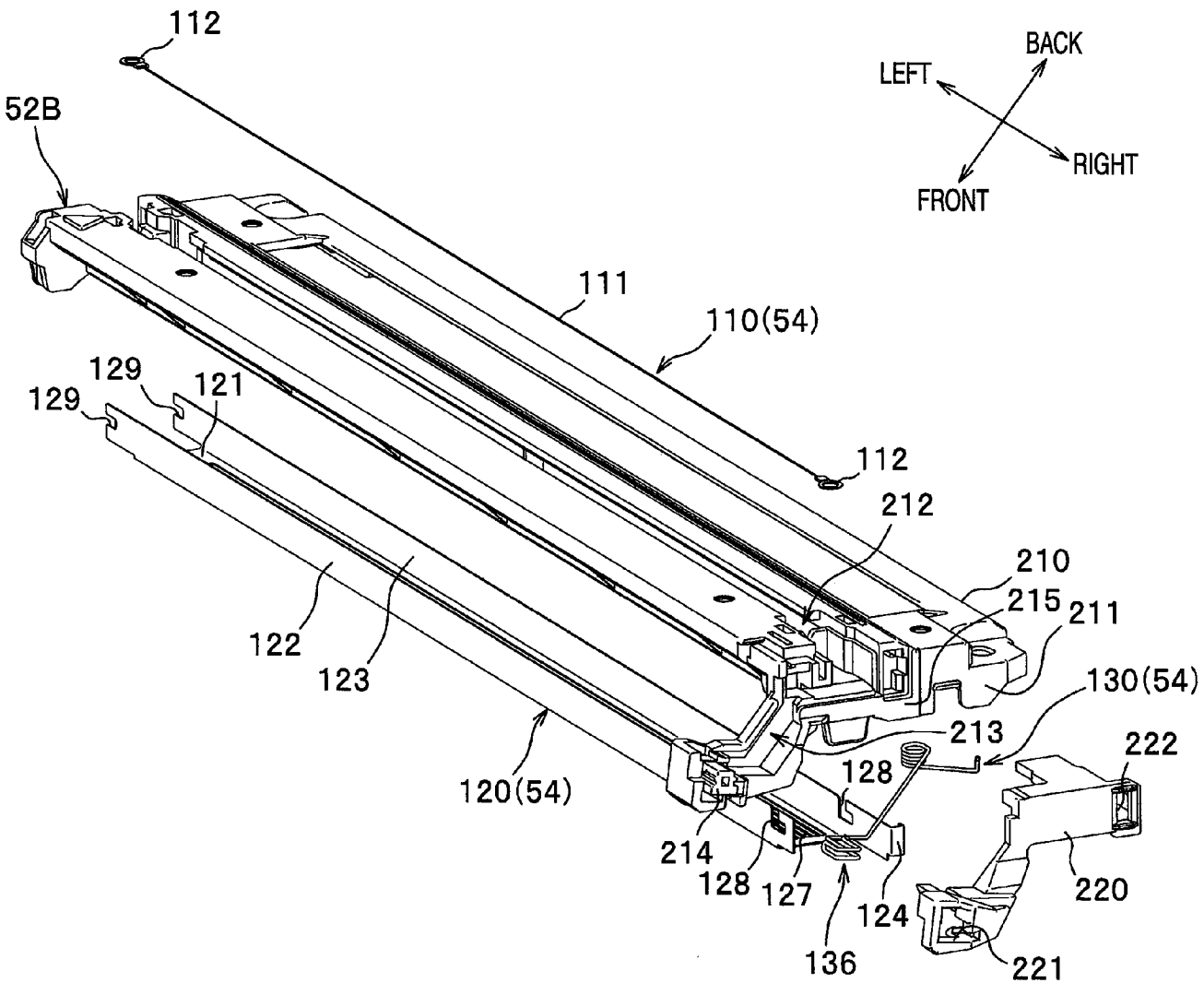
FIG. 5 is a schematic perspective view of the drum upper frame.

As shown in FIGS. 4 and 5, the drum upper frame 52B includes a frame main body 210, which is made from a resin molded article and which extends in the right-left direction, and an electrode cover 220 that is provided on one side surface 211 of the frame main body 210 in the right-left direction.

A mount groove 212, to which the charger 54 is to be attached, is formed in the frame main body 210 along a longitudinal direction thereof. A cleaning member (not shown) that cleans a wire 111 of a charged wire 110 (which will be described later) is slidably attached to the mount groove 212.

Figure 6:
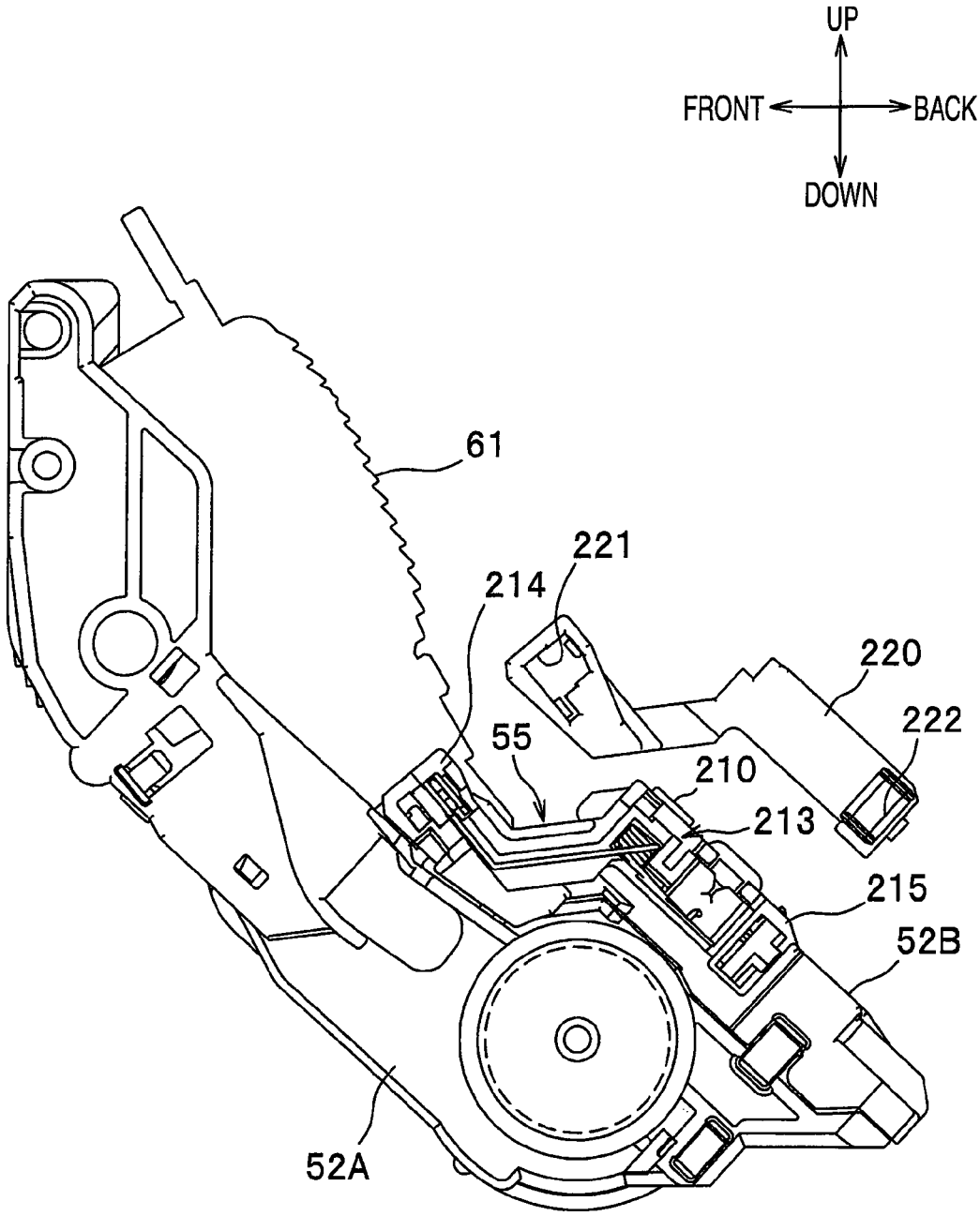
FIG. 6 is a schematic side view of the drum frame showing a state where an electrode cover of the drum upper frame is removed.

An electrode mounting portion 213, to which a wire electrode 130 (which will be described later) is provided, is formed in one side surface 211 of the frame main body 210. The electrode mounting portion 213 is formed such that the wire electrode 130 is fit. Specifically, the electrode mounting portion 213 is formed so as to extend toward a front side from a front end of the frame main body 210. Accordingly, as shown in FIG. 6, a front end portion 214 of the electrode mounting portion 213 is located at a front side of the exposure hole 55, which is provided between the drum upper frame 52B and the developing unit 61. In contrast, a back end portion 215 of the electrode mounting portion 213 is provided in a back side of the front end of the frame main body 210. Accordingly, the back end portion 215 is located at a back side of the exposure hole 55.

As shown in FIGS. 4 and 5, the electrode cover 220 has a space for housing the wire electrode 130 between the electrode cover 220 and a corresponding electrode mounting portion 213. A shape of the electrode cover 220 is substantially identical to that of the electrode mounting portion 213 in a side view. A first opening 221 for exposing to the outside wire-side connecting portion 136 of the wire electrode 130 (which will be described later) is formed in a front end portion of the electrode cover 220. Therefore, as shown in FIG. 3, the wire-side connecting portion 136 exposed through the first opening 221 is provided at a front side of the exposure hole 55.

A second opening 222 for exposing a grid-side connecting portion 124 of a grid 120 (see FIG. 4) (which will be described later) is formed in a back end portion of the electrode cover 220. Therefore, the grid-side connecting portion 124 exposed through the second opening 222 is located at the back side of the exposure hole 55, as shown in FIG. 3. Specifically, the wire-side connecting portion 136 and the grid-side connecting portion 124 are provided at positions where the exposure hole 55 is sandwiched therebetween as viewed from a side (i.e., a direction in which the charged wire 110 is stretched).

2. Charger

As shown in FIG. 5, each of the chargers 54 includes the charged wire 110, the grid 120 and the wire electrode 130.

The charged wire 110 includes the wire 111 made of metal and ring hooks 112 attached to both ends of the wire 111. The ring hook 112 at one end is engaged with the drum upper frame 52B, and the ring hook 112 at the other end is pulled by the wire electrode 130. Accordingly, the charged wire 110 is stretched in the right-left direction (i.e., an axial direction of the photosensitive drum 53).

The grid 120 includes a lower plate 121, a front plate 122 and a back plate 123. The lower plate 121 extends in the right-left direction, that is, a direction in which the charged wire 110 is stretched. The front plate 122 and the back plate 123 are continual from lateral ends of the lower plate 121. The grid 120 is formed into a substantially U-shape in a side view thereof.

When attached into the drum upper frame 52B of the grid 120, the lower plate 121 is located in a position between the photosensitive drum 53 and the charged wire 110. A plurality of slit-shaped grid holes 127 functioning as a plurality of pores are arranged in a center portion of the lower plate 121.

The front plate 122 is formed so as to extend longer than the lower plate 121 in opposite directions along the right-left direction. A notch 128 opened in an upward direction of FIG. 5 (i.e., toward the drum upper frame 52B) is formed in a right end portion of the front plate 122. The notch 128 extends from up to down in FIG. 5 and takes a turn toward the right end so as to form a substantially L-shape. A notch 129 opened leftward is formed in a left end portion of the front plate 122.

The notches 128 and 129 are formed in the back plate 123, as well as the front plate 122. The right end of the back plate 123 extends further longer than the right end of the front plate 122 and is bent twice in a direction opposite to the lower plate 121 (i.e., toward the outside), so as to form a hook-shaped end. A right end face of the back plate 123 functions as a grid-side connecting portion 124 for use in applying a voltage to the grid 120. The grid-side connecting portion 124 is electrically connected to, upon contact with, the second main body electrode 102 of the main body casing 10 (see FIGS. 8A to 8D).

The notches 128 and 129 are used for engaging the grid electrode 120 with the drum upper frame 52B.

Figure 7A:
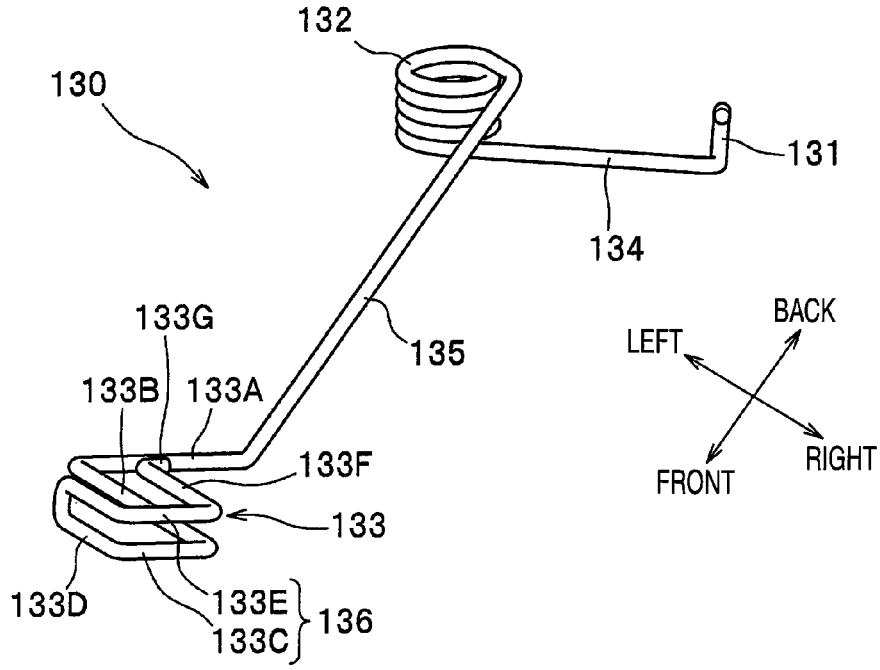
FIG. 7A is a perspective view showing a wire electrode.

The wire electrode 130 is used for applying a voltage to the charged wire 110. The wire electrode 130 is formed by bending a wire member made of metal. Specifically, as shown in FIG. 7A, the wire electrode 130 primarily includes a wire connecting portion 131, a spring-shaped portion 132 and a front end portion 133.

Figure 7B:
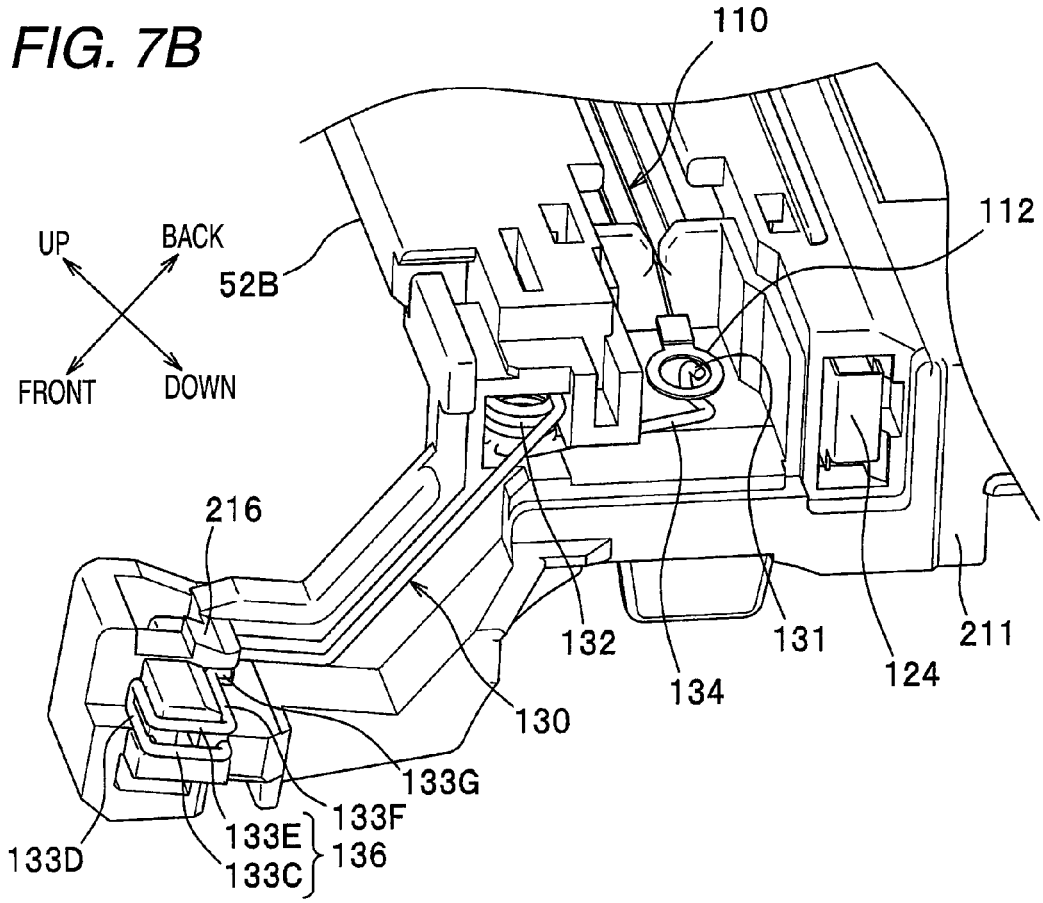
FIG. 7B is an enlarged perspective view showing a state where the wire electrode is attached to the drum upper frame.

The wire connecting portion 131 is formed into a substantially U-shaped hook. The wire connecting portion 131 is latched to the ring hook 112 of the charged wire 110, as shown in FIG. 7B, and is electrically connected to the charged wire 110. The wire connecting portion 131 is joined to one end of the spring-shaped portion 132 via a first arm portion 134 having a rod-shape.

The spring-shaped portion 132 is formed into a coil shape and is provided between the wire connecting portion 131 and the front end portion 133. As shown in FIG. 7B, the spring-shaped portion 132 imparts tensile force to the charged wire 110 via the first arm portion 134 and the wire connecting portion 131 when the wire electrode 130 is attached to the charged wire 110 and the drum upper frame 52B.

The front end portion 133 is connected to the other end of the spring-shaped portion 132 via a second arm portion 135 having a rod-shape. Specifically, the front end portion 133 includes a first extended portion 133A, a second extended portion 133B, a first contact portion 133C, a folded portion 133D, a second contact portion 133E, a third extended portion 133F and an engagement portion 133G.

The first extended portion 133A upwardly extends in a diagonally forward direction from a front end of the second arm portion 135.

The second extended portion 133B extends rightward (i.e., to the outside in the right-left direction) from a front end of the first extended portion 133A.

The first contact portion 133C upwardly extends in a diagonally forward direction from a right end of the second extended portion 133B. Specifically, the first contact portion 133C extends so as to follow a mounting direction X (see FIGS. 8A and 8C) in which the process cartridge 50 is mounted. The first contact portion 133C is exposed outside from the first opening 221 of the drum upper frame 52B (see FIG. 3). As shown in FIG. 7B, the first contact portion 133C is supported by a part of the drum upper frame 52B. Thus, movement of the first contact portion 133C in a direction departing from the second contact portion 133E can be regulated.

After extending from a front end of the first contact portion 133C to the left, the folded portion 133D is folded into a substantially U-shape and extends to the right side.

The second contact portion 133E downwardly extends from an end of the folded portion 133D on the opposite side of the first contact portion 133C, in an obliquely backward direction and in parallel with the first contact portion 133C. Thus, the second contact portion 133E is exposed outside through the first opening 221 of the drum upper frame 52B (see FIG. 3).

The second contact portion 133E and the first contact portion 133C configure the wire-side connecting portion 136. The wire-side connecting portion 136 is electrically connected to, upon contact with, the first main body electrode 101 of the main body casing 10 (see FIGS. 8A to 8D). Specifically, the wire-side connecting portion 136 is formed into two lines that are parallel with each other.

By virtue of the second extended portion 133B, the wire-side connecting portion 136 is located in a position outward of the one side surface 211 of the drum upper frame 52B in the right-left direction. Therefore, the wire-side connecting portion 136 is located outwardly of the grid-side connecting portion 124, that is exposed so as to slightly protrude from the one side face 211 of the drum upper frame 52B, in the right-left direction (i.e., outwardly in the direction in which the charged wire 110 is stretched). Further, the wire-side connecting portion 136 is provided in the back side of the grid-side connecting portion 124 in the mounting direction X (see FIGS. 8A and 8C).

The third extended portion 133F extends leftwardly from a back end of the second contact portion 133E.

The engagement portion 133G is formed by folding a distal of the third extended portion 133F in a backwardly oblique direction along the second contact portion 133E.

As shown in FIG. 7B, the engagement portion 133G is engaged with an engagement piece 216 from the second extended portion 133B. The engagement piece 216 is formed in the drum upper frame 52B. When the first main body electrode 101 (which will be described later) forcefully expends a space between the first contact portion 133C and the second contact portion 133E as a result of entering the space, movement of the engagement portion 133G is regulated by the engagement piece 216, and one of arms of the third extended portion 133F and the folded portion 133D is bent around a curve of the engagement portion 133G and a curve of the folded portion 133D and is deformed (see FIGS. 8A to 8D). By virtue of deformation of one of the arm of the third extended portion 133F and the arm of the folded portion 133D, urging force that makes the second contact portion 133E close to the first contact portion 133C occurs, and the first main body electrode 101 can be surely sandwiched between the first contact portion 133C and the second contact portion 133E. (CONNECTION BETWEEN CONNECTING PORTIONS OF CHARGER AND MAIN BODY ELECTRODES)

Referring to FIGS. 8A to 8D, a connection between the grid-side connecting portion 124 and the first main body electrode 101 and a connection between the wire-side connecting portion 136 and the second main body electrode 102 will be described.

The first and second main body electrodes 101 and 102 are pin-shaped electrodes whose distal ends are rounded. The first and second main electrodes 101 and 102 are urged toward distal ends by an elastic member of the main body casing 10. The first main body electrode 101 is connectable with the charged wire 110. The second main body electrode 102 is connectable with the grid 120.

Figure 8A:
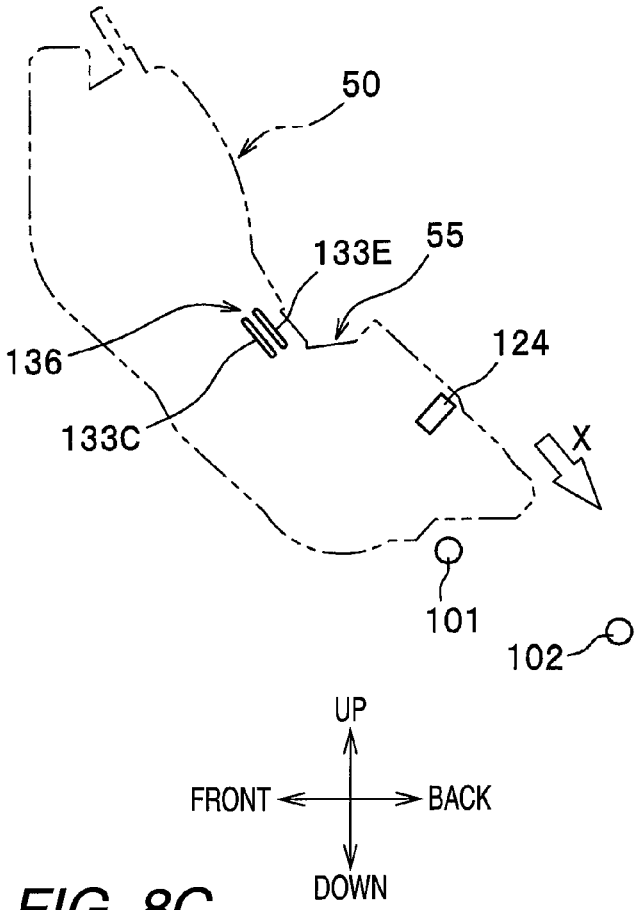
FIGS. 8A to 8D are explanatory drawings showing a relationship between the process cartridge and an apparatus main body.

As shown in FIG. 8A, the process cartridge 50 is inserted into the main body casing 10 along the mounting direction X guided by a guide (not shown) formed in the main body casing 10 so as to move substantially the same direction in which the wire-side connecting portion extends. Incidentally, the process cartridge 50 is inserted into the main body casing 10 while a clearance is formed between the process cartridge and the guide of the main body casing 10.

Figure 8B:
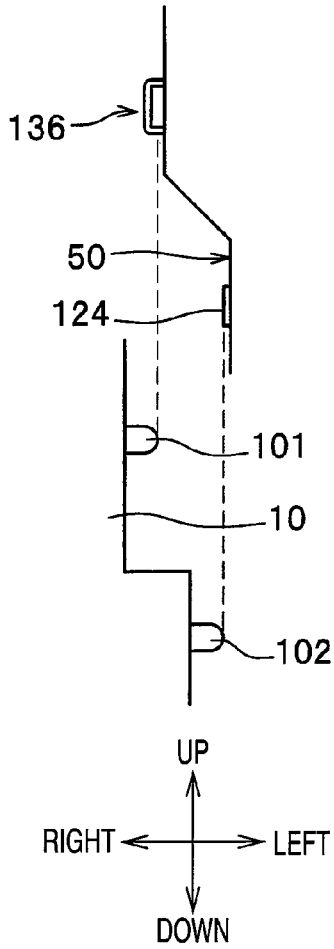

When the process cartridge 50 is inserted to the main body casing 10, the grid-side connecting portion 124, which is located at the distal end portion of the process cartridge 50 in the mounting direction X, approaches the first main body electrode 101 located at the back of the main body casing 10 in the mounting direction X, as shown in FIG. 8B. Thus, the first main body electrode 101 is located backwardly of the second main body electrode 102 with respect to the mounting direction X and outwardly with respect to the right-left direction.

Therefore, even when the grid-side connecting portion 124 has approached the first main body electrode 101, a distance in the right-left direction between them can be ensured. Therefore, occurrence of an erroneous contact between the grid-side connecting portion 124 and the first main body electrode 101 can be prevented.

Figure 8C:
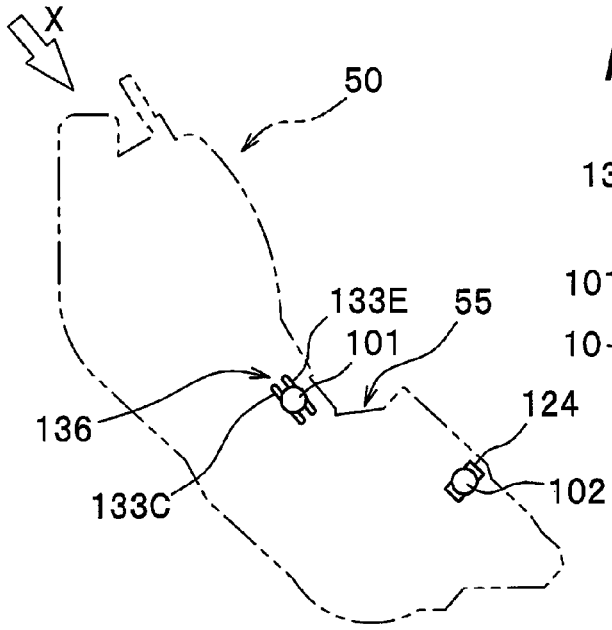
Figure 8D:
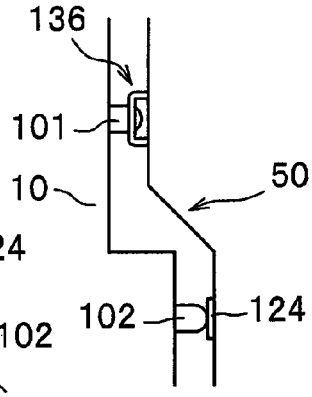

Subsequently, when the process cartridge 50 is mounted to the main body casing 10 as shown in FIG. 8C, the grid-side connecting portion 124 is connected to the second main body electrode 102 as shown in FIG. 8D, and the wire-side connecting portion 136 is connected to the first main body electrode 101.

At this time, in the wire-side connecting portion 136, the first contact portion 133C and the second contact portion 133E of are parallel to each other along the mounting direction X. The first main body electrode 101 is inserted between the first contact portion 133C and the second contact portion 133E. Accordingly, the first main body electrode 101 is slide contactable with the first contact portion 133C and the second contact portion 133E.

According to the exemplary embodiments of the invention, the grid-side connecting portion 124 and the wire-side main body connections 136 are arranged at positions that are spaced apart from each other with the exposure hole 55 interposed therebetween. Thus, the grid-side connecting portion 124 and the wire-side connecting portion 136 can be separated from each other by at least a distance corresponding to the exposure hole 55. Therefore, leakage of electricity from the wire-side connecting portion 136 to the grid-side connecting portion 124 can be prevented even when the size of the process cartridge 50 is reduced.

According to the exemplary embodiments of the invention, the wire-side connecting portion 136 is formed in the form of two parallel lines by the first and second contact portions 133C and 133E. Thus, the first main body electrode 101 can be pressed between the first and second contact portions 133C and 133E by a pressing force, and the first main body electrode 101 and the wire-side connecting portion 136 can be stably connected with each other. Incidentally, if the wire-side connecting portion 136 is formed into a single line, the first main body electrode 101 having a rounded distal end may slide with respect to the wire-side connecting portion 136 formed into the single line. In such a case, the wire-side connecting portion 136 formed into the single line may fail to press the first main body electrode 101 at an appropriate pressing force, and it may be difficult to establish stable connection between the wire-side connecting portion 136 and the first main body electrode 101.

According to the exemplary embodiments of the invention, the wire-side connecting portion 136, which is formed in the form of two parallel lines by the first and second contact portions 133C and 133E, slides in the mounting direction X with sandwiching the first main electrode 101. Therefore, the first main body electrode 101 can be surely connected to the wire-side connecting portion 136. Incidentally, if the first and second contact portions 133C and 133E are oriented in a direction crossing the mounting direction X, the first main body electrode 101 may not be inserted between the first and second contact portions 133C and 133E unless the first main body electrode 101 gets over any one of the first and second contact portions 133C and 133E. If the first main body electrode 101 fails to get over one of the first and second contact portions 133C and 133E, the first main body electrode 101 cannot be pressed against the wire-side connecting portion 136 by the appropriate pressing force, and it may be difficult to establish the stable connection between the wire-side connecting portion 136 and the first main body electrode 101.

According to the exemplary embodiments of the invention, the wire electrode 130 has the spring-shaped portion 132 that imparts tensile force to the charged wire 110. Therefore, additional component for imparting tensile force to the charged wire 110 may not be required. Thus, it may be possible to reduce a cost.

According to the exemplary embodiments of the invention, the wire-side connecting portion 136 is located outwardly of the grid-side connecting portion 124 with respect to the right-left direction (see FIGS. 8B and 8D), as well as being located backward of the grid-side connecting portion 124 in the mounting direction X (see FIGS. 8A and 8C). Thus, a distance in the right-left direction between the grid-side connecting portion 124 and the first main body electrode 101 can be assured. Accordingly, occurrence of an erroneous contact between the grid-side connecting portion 124 and the first main body electrode 101 can be prevented. Further, the wire-side connecting portion 136 and the grid-side connecting portion 124 are arranged so as to be offset from each other with respect to a direction orthogonal to the mounting direction X (see FIGS. 8A and 8C). Therefore, a distance between the grid-side connecting portion 124 and the first main body electrode 101 can be assured in the direction orthogonal to the mounting direction X, and occurrence of an erroneous contact between the grid-side connecting portion 124 and the first main body electrode 101 can be prevented.

Incidentally, in the above-described exemplary embodiments, the process cartridge integrally includes the developer housing chamber 66 that houses the developer. Alternatively, a developing cartridge, which is separated from a developer cartridge and has a developer housing chamber, may also be adopted as the process cartridge.

In the above-described exemplary embodiments, the LED units 40 are inserted into the respective exposure holes 55. Alternatively, a laser beam may be irradiated to pass through the exposure holes 55.

In the above-described exemplary embodiments, the wire electrode is formed from a line-shaped member made of metal. Alternatively, the wire electrode may be formed from, for example, a plate-like member. In this case, the wire-side connecting portion may also be formed into the shape of a flat plate or embodied as elements formed by simply bending a spring-shaped portion.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. A process cartridge comprising:
a photosensitive member;
a charger, which charges the photosensitive member, the charger comprising:
a charged wire;
a grid that is interposed between the charged wire and the photosensitive member;
a wire-side connecting portion that applies a voltage to the charged wire; and
a grid-side connecting portion that applies a voltage to the grid; and
a process frame, which supports the photosensitive member and the charger, and which comprises an exposure opening that faces the photosensitive member, the exposure opening being provided between the wire-side connecting portion and the grid-side connecting portion when viewed from a first direction in which the charged wire is stretched.

2. The process cartridge according to claim 1,
wherein the wire-side connecting portion comprises two lines that are parallel to each other.

3. The process cartridge according to claim 2,
wherein the wire-side connecting portion is elongated in a second direction.

4. The process cartridge according to claim 3,
wherein the charger further comprises:
a wire electrode that connects the charged wire to the wire-side connecting portion, and
wherein the wire electrode comprises:
a connecting portion connected to the charged wire; and
a spring-shaped portion, which is provided between the connecting portion and the wire-side connecting portion, and which applies a tensile force to the charged wire via the connecting portion.

5. The process cartridge according to claim 3,
wherein the wire-side connecting portion is provided at a position, which is outwardly of the grid-side connecting portion in the first direction, and which is on an upstream side of the grid-side connecting portion in the second direction.

6. The process cartridge according to claim 1,
wherein the charger further comprises:
a wire electrode that connects the charged wire to the wire-side connecting portion, and
wherein one end of the wire electrode is folded so as to form a first line and a second line that are parallel to each other.

7. The process cartridge according to claim 1,
wherein the grid-side connecting portion and the wire-side connecting portion are provided at one side of the charger.

8. An image forming apparatus comprising:
the process cartridge according to claim 1 that is removably mounted to the image forming apparatus in a second direction which is perpendicular to the first direction; and
a main body casing comprising:
a first main body electrode that is connectable with the wire-side connecting portion; and
a second main body electrode that is connectable with the grid-side connecting portion,
wherein the wire-side connecting portion is elongated in the second direction.

9. The image forming apparatus according to claim 8, further comprising:

an exposure unit that generates a light for exposing the photosensitive member, wherein the exposure opening passes the light from the exposure unit to the photosensitive member.

10. The image forming apparatus according to claim 8, wherein the wire-side connecting portion comprises two lines, which are parallel to each other, and which are elongated in the second direction, and wherein the first main body electrode is insertable between the two lines in the second direction.

11. The image forming apparatus according to claim 8, wherein the first main body electrode is provided at a position, which is outwardly of the second main body electrode in the first direction, and which is on an upstream side of the second main body electrode in the second direction.

* * * * *